US008769801B2

(12) United States Patent
Lyman

(10) Patent No.: US 8,769,801 B2
(45) Date of Patent: Jul. 8, 2014

(54) BIOMASS BALE PROCESSING SYSTEM WITH AUTOMATIC BINDING REMOVER

(76) Inventor: Mark Gerlinger Lyman, Salem, OR (US)

( * ) Notice: Subject to any disclaimer, the term of this patent is extended or adjusted under 35 U.S.C. 154(b) by 40 days.

(21) Appl. No.: 13/540,457

(22) Filed: Jul. 2, 2012

(65) Prior Publication Data

US 2013/0000261 A1 Jan. 3, 2013

Related U.S. Application Data

(60) Provisional application No. 61/503,610, filed on Jun. 30, 2011, provisional application No. 61/505,444, filed on Jul. 7, 2011.

(51) Int. Cl.
*B23P 23/00* (2006.01)
*B65B 69/00* (2006.01)

(52) U.S. Cl.
USPC ..... 29/564.3; 29/426.4; 83/909

(58) Field of Classification Search
USPC ..... 29/564.3, 426.4, 426.3; 83/909
See application file for complete search history.

(56) References Cited

U.S. PATENT DOCUMENTS

| | | | | |
|---|---|---|---|---|
| 2,316,725 | A | 4/1943 | Symons | |
| 3,513,522 | A | 5/1970 | Thomson | |
| 5,044,937 | A * | 9/1991 | Lisa | 432/5 |
| 5,216,797 | A | 6/1993 | Hall | |
| 5,297,329 | A * | 3/1994 | Santin et al. | 29/564.3 |
| 5,680,691 | A | 10/1997 | Marom | |
| 5,799,801 | A | 9/1998 | Clark | |
| 5,960,964 | A | 10/1999 | Austin et al. | |
| 6,234,322 | B1 | 5/2001 | Paladin | |
| 2004/0069693 | A1 | 4/2004 | Paladin | |
| 2005/0137744 | A1 | 6/2005 | Winkelmolen et al. | |
| 2009/0236268 | A1 | 9/2009 | Shulman | |
| 2010/0281767 | A1 | 11/2010 | Zeeck | |
| 2011/0041390 | A1 | 2/2011 | Flick et al. | |
| 2011/0113941 | A1 | 5/2011 | Norberg et al. | |
| 2013/0000261 | A1 | 1/2013 | Lyman | |

FOREIGN PATENT DOCUMENTS

| | | |
|---|---|---|
| CN | 201541696 U | 8/2010 |
| GB | 512810 | 8/1939 |
| GB | 2466215 | 6/2010 |

OTHER PUBLICATIONS

International Search Report and Written Opinion dated Dec. 17, 2012, International Application No. PCT/US2012/055344, International Filing Date Sep. 14, 2012.
International Search Report and Written Opinion dated Sep. 17, 2012, International Application No. PCT/US2012/045315, International Filing Date Jul. 2, 2012.
International Search Report and Written Opinion dated Sep. 17, 2012, International Application No. PCT/US2012/045307, International Filing Date Jul. 2, 2012.

* cited by examiner

*Primary Examiner* — Erica E Cadugan
(74) *Attorney, Agent, or Firm* — Lane Powell PC

(57) ABSTRACT

A bale processing apparatus for processing a bale of biomass that is bound by a binding includes a cutting device that is operable to automatically cut the binding. The bale processing apparatus also includes a binding remover that is operable to automatically move the binding from the bale after the binding has been cut by the cutting device. Furthermore, the bale processing apparatus includes an arranging member that cooperates with the binding remover to automatically arrange the binding generally into a predetermined position.

14 Claims, 9 Drawing Sheets

BIOMASS BALE PROCESSING SYSTEM WITH AUTOMATIC BINDING REMOVER

CROSS-REFERENCE TO RELATED APPLICATIONS

This application claims the benefit of U.S. Provisional Application No. 61/503,610, filed on Jun. 30, 2011. This application also claims the benefit of U.S. Provisional Application No. 61/505,444, filed on Jul. 7, 2011. The entire disclosures of the above applications are incorporated herein by reference.

FIELD

The present disclosure relates to bale processing systems and, more particularly, to a bale processing system with an automatic binding remover.

BACKGROUND

This section provides background information related to the present disclosure which is not necessarily prior art.

Some materials are baled to facilitate storage and transport. For example, stalks, leaves, grasses, etc. are compacted and bound into a bale to be transported from a farm to a biomass processing plant for the production of ethanol or other product.

The bale is typically broken down or reduced before the materials in the bale can be processed. For example, the stalks, leaves, grasses, etc. in the bale are typically separated from other portions of the bale for cleaning, exposure to chemical processes, etc. The materials can also be cut, chopped, or otherwise reduced for facilitating these processes.

In some cases, the bales are bound by string, rope, cords, webbing, etc. Typically, these bindings are manually cut and removed from the bale, and then the bale is separated manually (e.g., using a pitchfork or other similar tool) and loaded into a chopper or other machine manually. These manual methods can be labor intensive and inefficient.

SUMMARY

This section provides a general summary of the disclosure, and is not a comprehensive disclosure of its full scope or all of its features.

A bale processing apparatus for processing a bale of biomass that is bound by a binding is disclosed. The bale processing apparatus includes a cutting device that is operable to automatically cut the binding. The bale processing apparatus also includes a binding remover that is operable to automatically move the binding from the bale after the binding has been cut by the cutting device. Furthermore, the bale processing apparatus includes an arranging member that cooperates with the binding remover to automatically arrange the binding generally into a predetermined position.

Also, a method of processing a bale of biomass material that is bound by a binding is disclosed. The method includes automatically cutting the binding with a cutting device. The method also includes automatically removing the binding from the bale with a binding remover after the binding has been cut. Moreover, the method includes automatically arranging the binding using an arranging member that cooperates with the binding remover to arrange the binding generally into a predetermined position.

Still further, a biomass processing apparatus for processing a bale of biomass is disclosed. The bale of biomass includes a binding. The biomass processing apparatus includes a conveyor that conveys the bale of biomass with the binding toward a support surface. The bale processing apparatus also includes a holding device that selectively and automatically holds the bale against the support surface. Moreover, the bale processing apparatus includes a cutting device that automatically cuts the binding while the holding device holds the bale against the support surface. Furthermore, the bale processing apparatus includes a binding remover that is operable to automatically remove the binding from the bale of biomass after the binding has been cut by the cutting device. The binding remover includes a head member that moves linearly across an outer surface of the bale, and an end of the head member is operable to penetrate into the bale to move between the bale and the binding as the head member moves linearly across the outer surface of the bale. The end is operable to direct the binding into a head opening of the head member. The head member is operable to drag the binding from the bale as the head member moves away from the bale. Still further, the bale processing apparatus includes an arranging member that defines a support opening, and the head member is operable to move through the support opening and to drag the binding through the support opening to thereby align and arrange the binding into a first predetermined position. The arranging member and the head member are operable to cooperatively support the binding when in the first predetermined position. Additionally, the bale processing apparatus includes a gathering member operable to automatically gather the binding from the head member while the head member and the arranging member cooperatively support the binding. The gathering member includes a base and a plurality of tines that are operable to rotate about a gathering axis. The plurality of tines are operable to move between a retracted position and an extended position, wherein the plurality of tines are operable to move from the retracted position to the extended position and to rotate about the gathering axis to thereby wind the binding about the plurality of tines, and wherein the plurality of tines are operable to move from the extended position to the retracted position to thereby expel the binding from the gathering member. Moreover, the bale processing apparatus includes a sensor that is operable to detect at least one of a metal content of the bale, a moisture content of the bale, a size of the bale, and a weight of the bale.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1A:
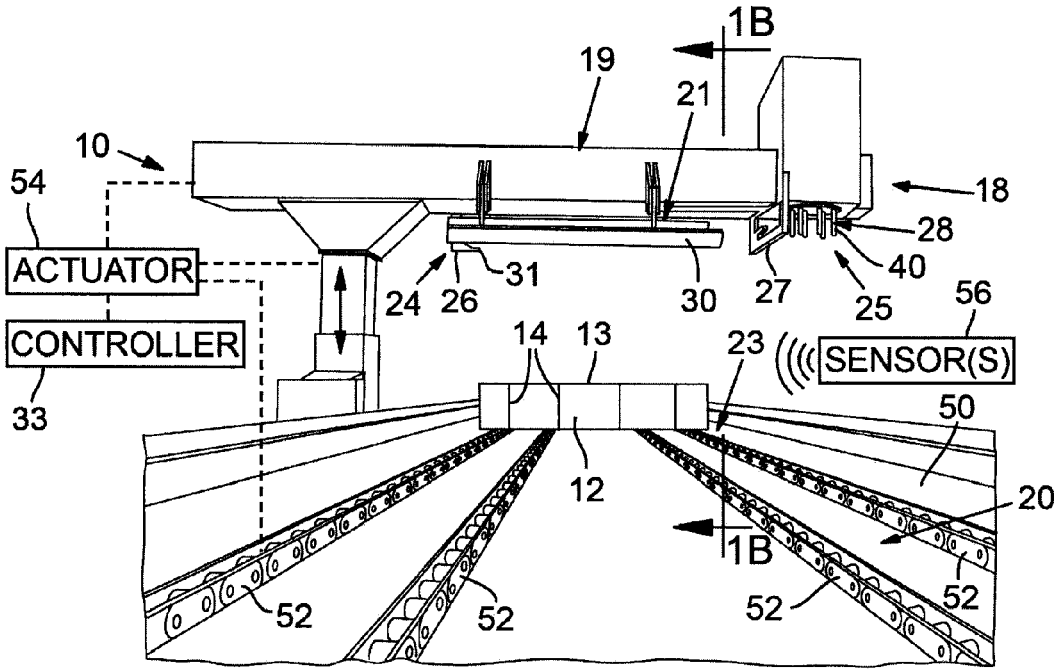
FIG. 1A is an end view of a biomass bale processing apparatus with a support beam shown in its raised position.
Figure 2:
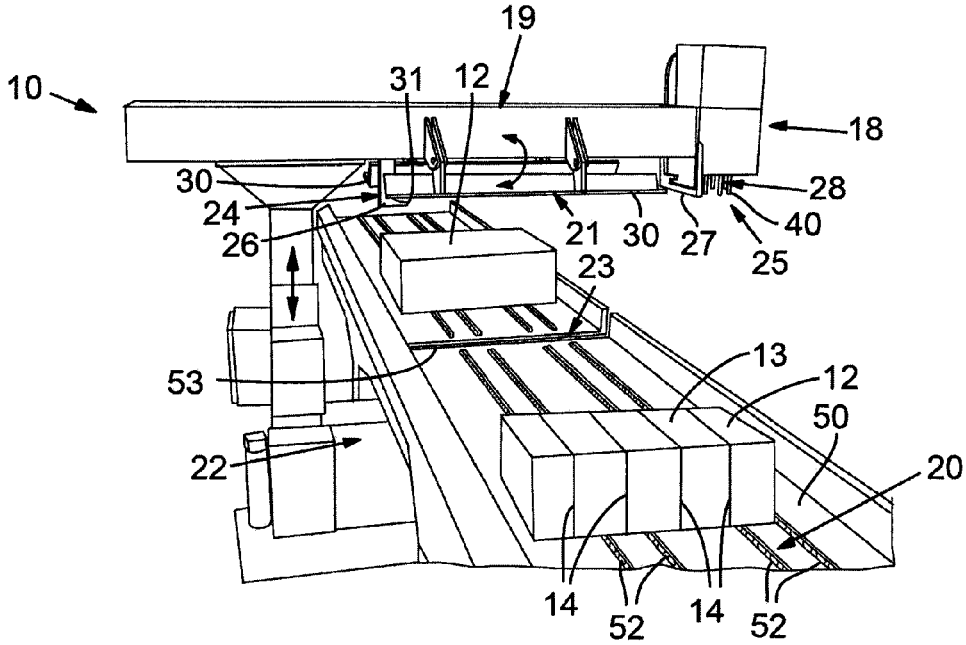
FIG. 2 is an end view of the bale processing apparatus of FIG. 1A.

Referring initially to FIGS. 1A and 2, a bale processing apparatus 10 is illustrated. The apparatus 10 can be used for processing bales 12 of biomass material. In some embodiments, the bales 12 can be bales of biomass, such as corn stover (i.e., stalks, leaves, and other portions of the corn plant other than the ear of corn), plant waste, tree waste, or other biological material.

Figure 11:
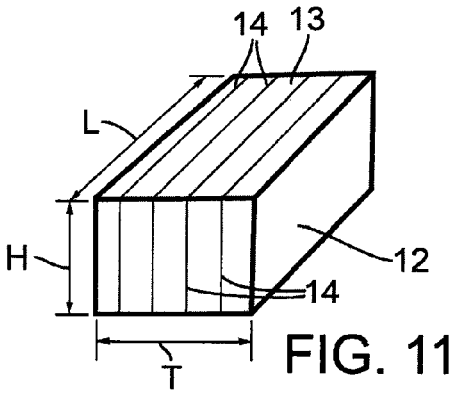
FIG. 11 is a perspective view of a bale of material.

The bales 12 can be box-shaped as shown in FIG. 11. Thus, the bale 12 can define a height direction, H, a length direction, L, and a transverse or width direction, T. The bale 12 can also include an outer surface 13. The bale 12 can be shaped in other ways as well. For instance, the bale 12 can be generally rounded and cylindrical such that the bale 12 has a diameter and a height.

Also, the bales 12 can be compressed and bound by a binding 14, such as string, rope, a band, a belt, webbing, etc. In the embodiments of FIG. 11, the bale 12 includes a plurality of individual bindings 14 that each extend longitudinally and continuously about four sides of the outer surface 13 (i.e., in the height, H, and length, L, directions). It will be appreciated that the bale 12 can be bound by a single binding 14 as well and that the binding 14 can extend about the bale 12 in any direction.

Figure 12:
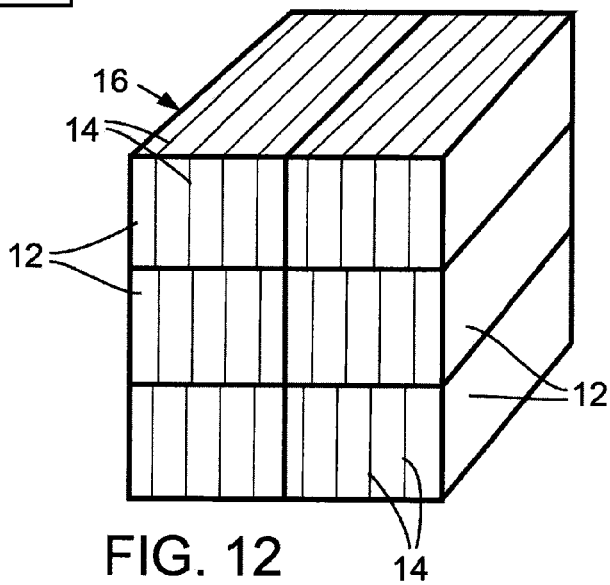
FIG. 12 is a perspective view of a stack of bales.

Moreover, a plurality of bales 12 can be arranged in a stack 16 as shown in FIG. 12. The stack 16 can include any number of individual bales 12. Each bale 12 within the stack 16 can include respective bindings 14. The stack 16 can be compressed, bound, palletized, etc. so that the stack 16 can be moved as a unit.

Figure 4:
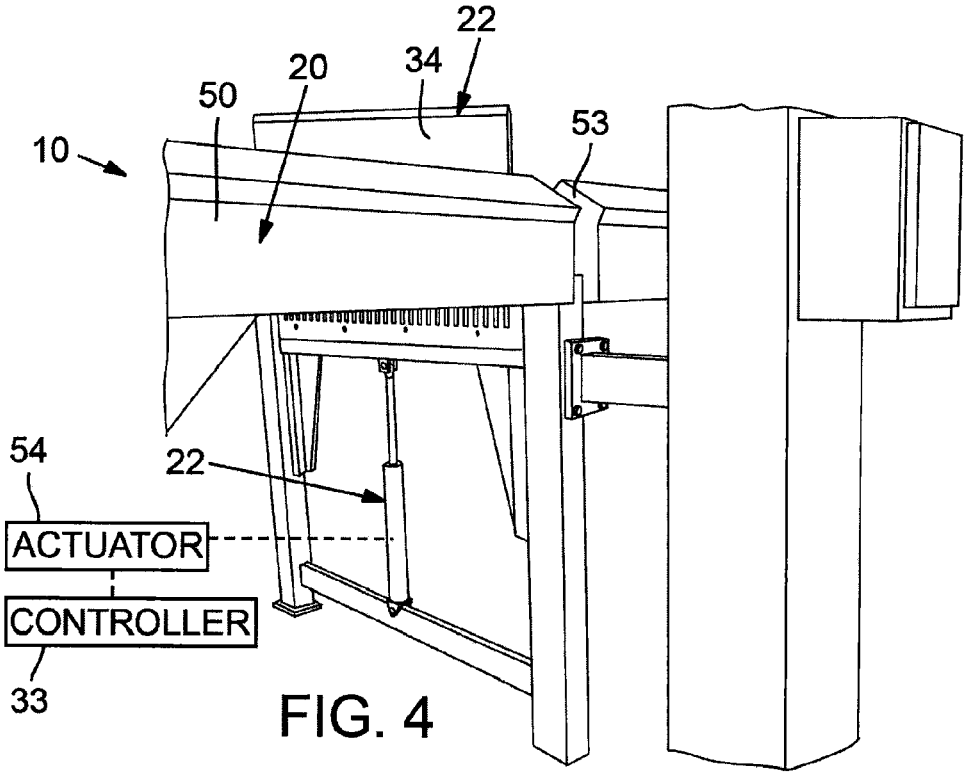
FIG. 4 is a detail view of the cutting member of the bale processing apparatus of FIG. 1A, wherein the cutting member is shown in its extended position.
Figure 5:
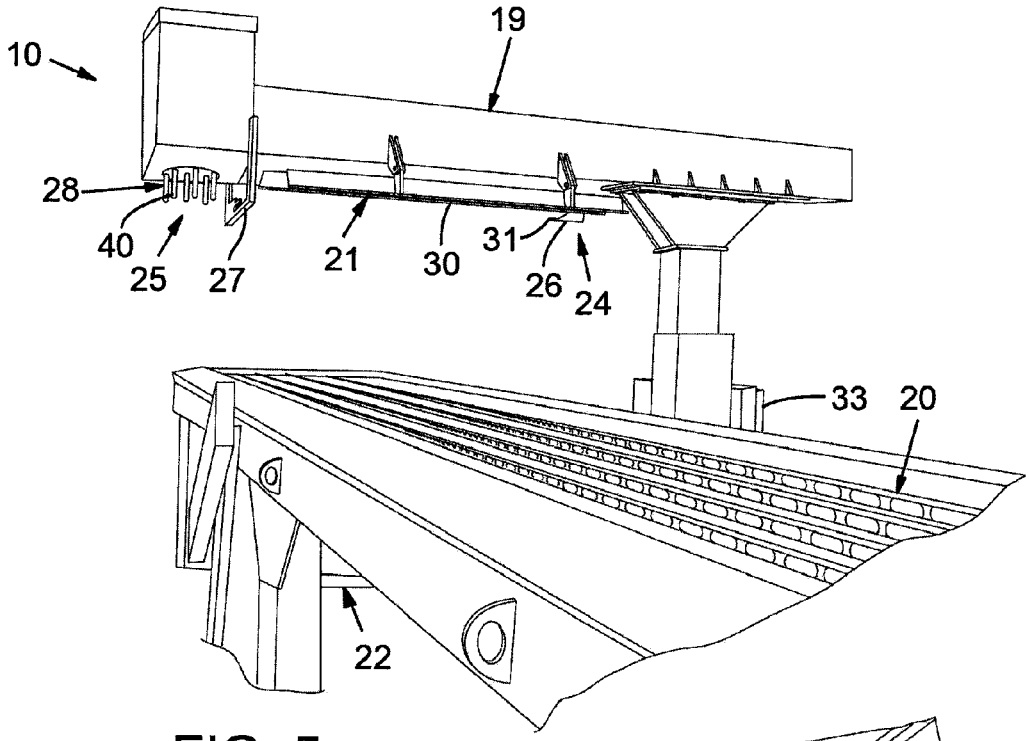
FIG. 5 is an end view of the bale processing apparatus of FIG. 1A.
Figure 6:
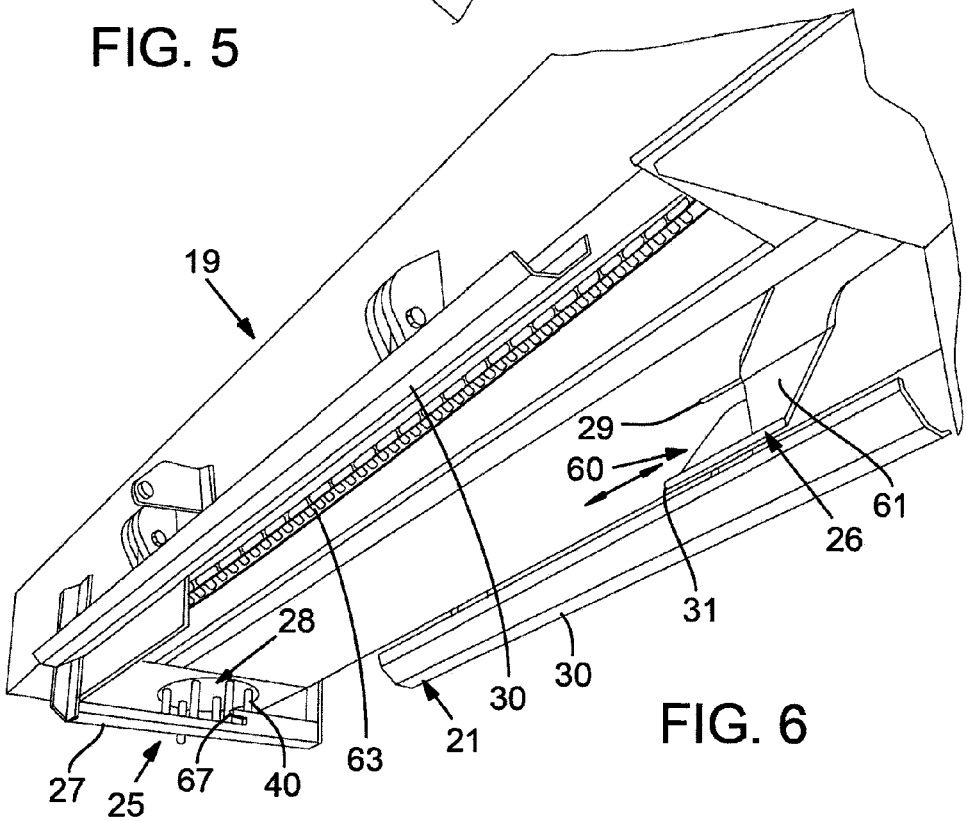
FIG. 6 is a detail view of a gathering member of the bale processing apparatus of FIG. 1A.
Figure 9:
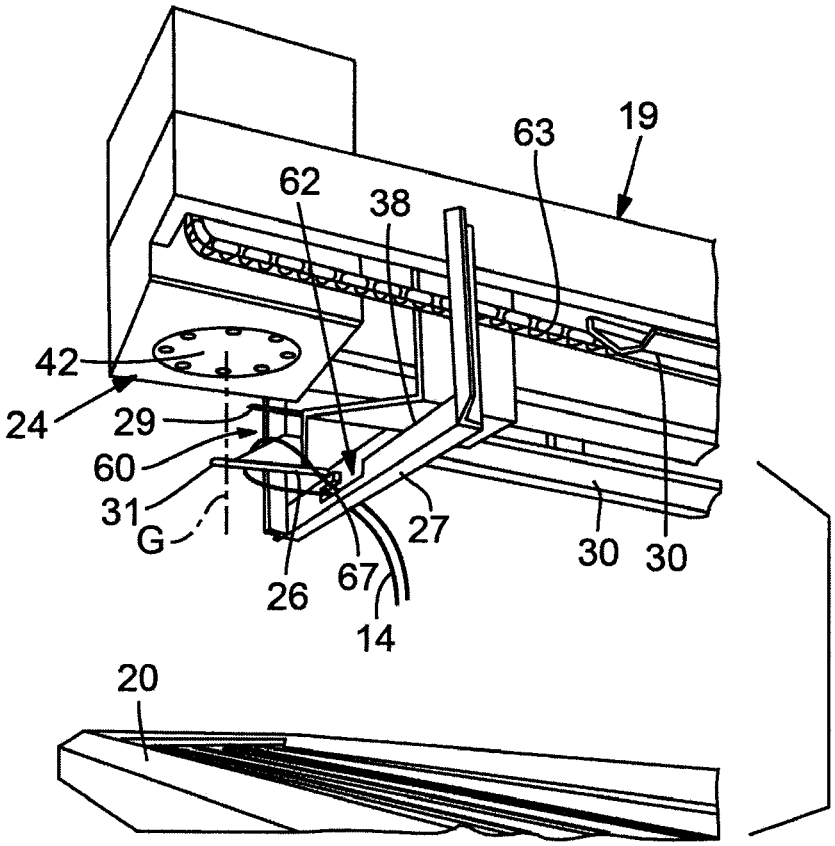
FIG. 9 is a side view of the gathering member of FIG. 6.
Figure 10:
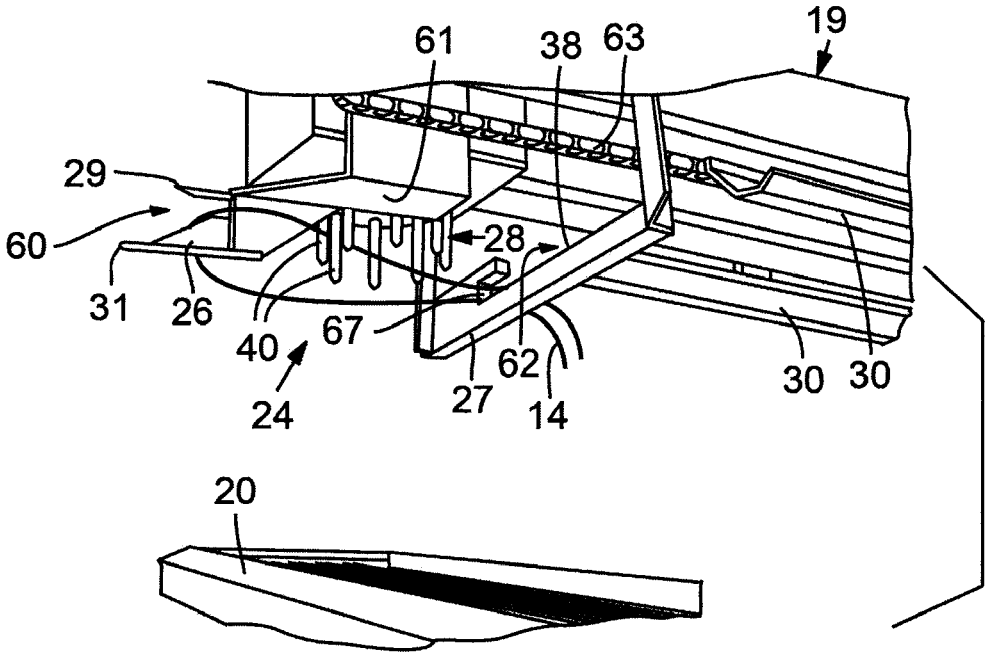
FIG. 10 is a side view of the gathering member of FIG. 6.

Referring back to FIGS. 1A and 2, the apparatus 10 can include a conveyor 20 with a support surface 23, an upper support beam 19, a bale holder 21, a cutting device 22 (FIGS. 3 and 4), and a binding remover 24 (FIGS. 5 and 6). As will be discussed, the conveyor 20 can convey individual bales 12 into position such that the cutting device 22 can automatically cut the binding 14 from the bale 12. Then, the binding remover 24 can automatically remove the binding 14 from the bale 12 after the binding 14 has been cut by the cutting device 22. In some embodiments, the binding remover 24 can include a hook-shaped head member 26 that actuates relative to the bale 12 to remove the binding 14 from the bale 12. Also, the apparatus 10 can include a gathering member 25 (FIGS. 1, 2, 7 and 8) that is operable to automatically gather the binding 14 from the head member 26 and dispose of the binding 14 in a predetermined area. Additionally, the gathering member 25 can include a winder 28 that winds and collects the binding 14 from the head member 26. Moreover, in some embodiments, the apparatus 10 can include an arranging member 27 that can cooperate with the head member 26 to automatically align and otherwise arrange the binding 14 generally into a predetermined position (FIGS. 9 and 10). Also, the arranging member 27 can cooperate with the head member 26 to support the binding 14 in this predetermined position while the winder 28 gathers and collects the binding 14 (FIG. 10). Each of these components will be discussed in greater detail below.

Furthermore, as shown in FIG. 1A, the apparatus 10 can include an actuating system 54 (shown schematically). The actuating system 54 can include hydraulic and/or pneumatic actuators, electric motors, or other types of actuators for actuating moving parts of the apparatus 10. It will also be appreciated that the actuating system 54 can include a plurality of individual actuators for independently actuating respective moving parts of the apparatus 10.

Additionally, the apparatus 10 can include a controller 33, which is operable to control the actuating system 54 for partially or wholly automating these processes. The controller 33 can include computerized memory, programmed logic, and other components for these purposes. The controller 33 can also include input devices, such as buttons, knobs or other controls with which a user can input commands for operation of the apparatus 10. Additionally, the controller 33 can include a display or other output devices for communicating information to the user about operating conditions of the apparatus 10.

In some embodiments, the apparatus 10 can further include a sensor device 56 (i.e., a bale sensor shown schematically in FIG. 1A). The sensor device 56 can be operable for detecting one or more conditions and characteristics of the bale 12. For instance, in some embodiments, the sensor device 56 can be operable to automatically detect a size of the bale 12 (e.g., the height of the bale 12), a weight of the bale 12, a moisture content of the bale 12, a metal content of the bale 12, and/or another characteristic. The sensor device 56 can include any suitable sensor, such as a proximity sensor, a scale, a magnet that detects ferro-magnetic material in the bale 12, etc. In some embodiments, the sensor device 56 can analyze the bale 12 before the binding 14 is removed from the bale 12. Thus, the sensor device 56 can be used as quality control to ensure that the bale 12 meets predetermined criteria before being further processed, and the bale 12 can be removed from the apparatus 10 if it does not meet the predetermined criteria.

The sensor device 56 can also be used to help automate parts of the apparatus 10. For instance, the sensor device 56 can include cameras, light detectors, pressure sensors, proximity sensors, or other sensors that are used to detect a size of the bale 12 and/or a position of the bale 12 within the apparatus 10. As such, the controller 33 can automatically actuate the various components based on the detected size and/or position of the bale 12 as will be discussed in detail below.

It will be appreciated that the bale processing apparatus 10 can be part of a continuous system, wherein bales 12 are separated from the stack 16 (FIG. 12) and fed to the apparatus 10 at predetermined intervals. Then, as will be discussed, the bale processing apparatus 10 can automatically cut the binding 14 from the bale 12 and subsequently remove the binding 14 from the bale 12 (see FIG. 1B). Next, the bale processing apparatus 10 can automatically gather and dispose of the cut bindings 14 as will be discussed. The conveyor 20 can then deliver the unbound bale 12 to another machine, such as a chopper, etc. This process can be repeated continuously. Thus, the bale processing apparatus 10 can efficiently remove and dispose of the binding 14 from the bale 12 and prepare the bale 12 to be reduced (e.g., by chopping, shredding, etc.) and/or for later processing (e.g., screening, etc.). In some embodiments, the bales 12 can processed continuously, for instance, according to the teachings of Applicant's co-pending U.S. patent application Ser. No. 13/540,412, filed Jul. 2, 2012, which is hereby incorporated by reference in its entirety.

Components of the apparatus 10 will now be discussed in detail. For instance, the conveyor 20 can include a table 50 and a plurality of chains 52 (FIGS. 1A and 2). The table 50 can include a gap 53 (FIG. 2), and the cutting device 22 can actuate in and out of the gap 53 as will be discussed in detail below. The support surface 23 can be defined on the table 50 and/or chains 52 on both sides of the gap 53. The chains 52 can move continuously in a longitudinal direction relative to the table 50, and the bale 12 can be supported on the chains 52 to move therewith toward the gap 53 (and, thus, toward the cutting device 22). It will be appreciated that the conveyor 20 can also be a belt-type conveyor or other type of conveyor 20 without departing from the scope of the present disclosure.

The support beam 19 can be elongate and can include one or more strong, rigid beams that extend horizontally. The support beam 19 can extend over and transverse to the conveyor 20 and above the gap 53. In some embodiments, the support beam 19 can be moveably supported above the support surface 23. For instance, the support beam 19 can be operably connected to the actuating system 54 to selectively move vertically up and down relative to the support surface 23. The support beam 19 is shown in its raised position in FIG. 1A and the support beam 19 is shown in its lowered position in FIG. 1B.

Figure 1B:
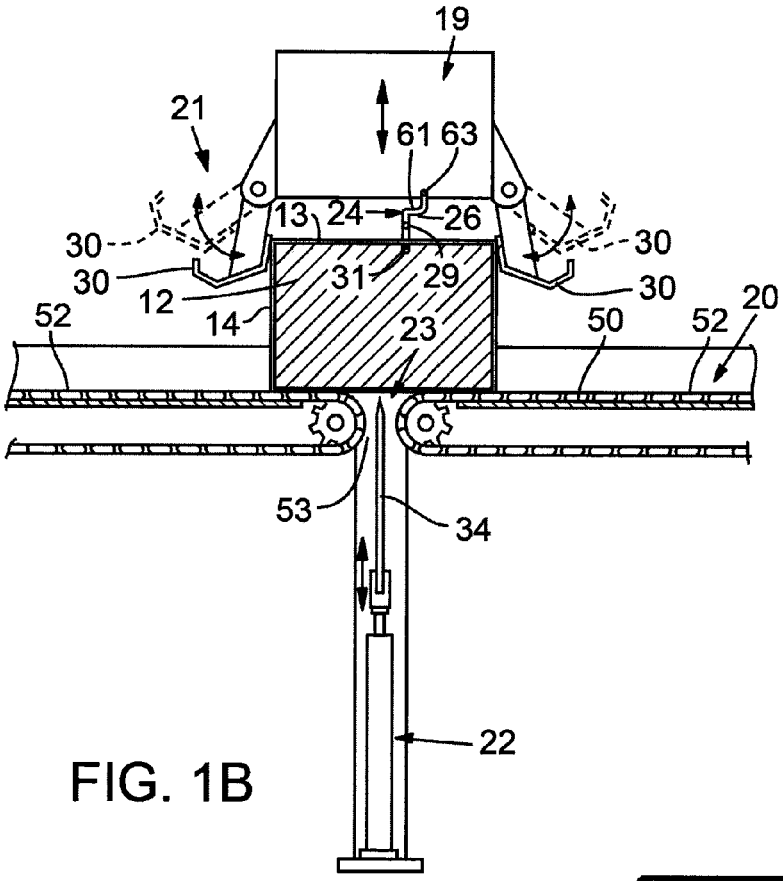
FIG. 1B is a side view taken along the line 1B-1B of FIG. 1A with the support beam shown in its lowered position, with a cutting member shown in its extended position for cutting a binding from a bale, and with a head member in the process of removing the binding from the bale.

The holder 21 can be moveably attached to the support beam 19. The holder 21 can include one or more (e.g., two) elongate arms 30. The arms 30 can have a generally L-shaped or C-shaped cross section as shown in FIG. 1B. The arms 30 can be moveably attached on opposite sides of the support beam 19. The arms 30 can be operably connected to the actuating system 54 to move pivotally in tandem between a raised, retracted position (shown in phantom in FIG. 1B) and a lowered, extended position (shown in solid lines in FIG. 1B).

Figure 3:
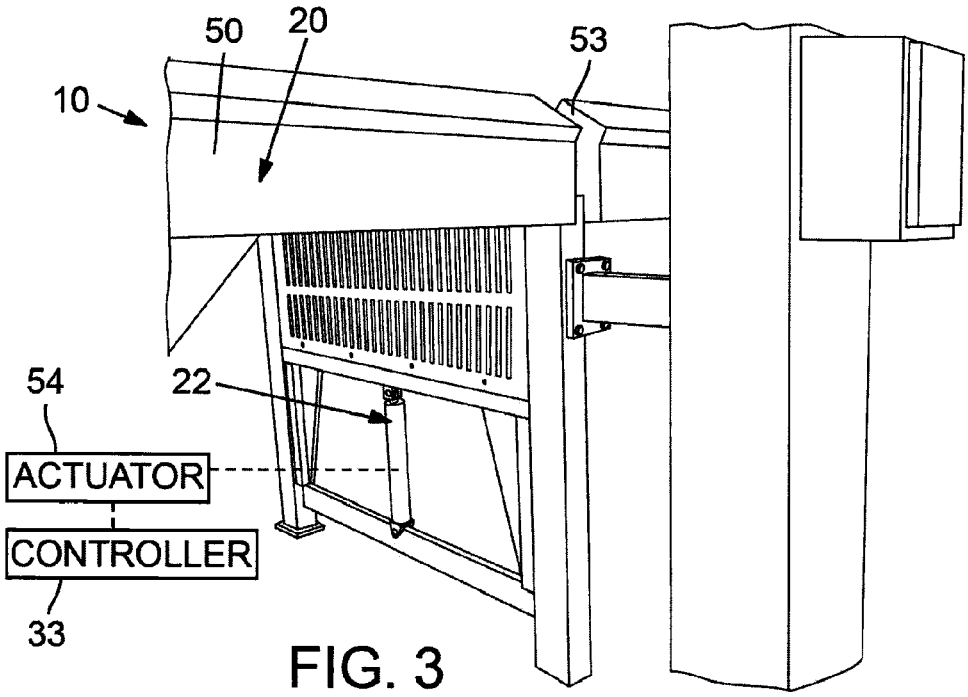
FIG. 3 is a detail view of the cutting member of the bale processing apparatus of FIG. 1A, wherein the cutting member is shown in its retracted position.

As shown in FIGS. 1B, 3 and 4, the cutting device 22 can include a guillotine-style blade 34 or other cutting member that is suitable for cutting through the binding 14 of the bale 12. The cutting device 22 can be positioned below the conveyor 20 and below the holder 21 for moving within the gap 53 (FIG. 1B). The blade 34 can be operably connected to the actuating system 54 to move linearly between a retracted (lowered) position (FIG. 3) and an extended (raised) position (FIG. 4). Stated differently, the blade 34 can move only linearly upward in a first direction and linearly downward in a second direction when moving between the extended and retracted positions. It will be appreciated that the bale 12 can be delivered such that the bindings 14 extend transverse (e.g., approximately perpendicular) to the blade 34 to ensure proper cutting.

Accordingly, with the support beam 19 in its raised position, the elongate arms 30 in the retracted position, and the blade 34 in its retracted position (FIG. 1A), the conveyor 20 can deliver the bale 12 to the support surface 23, below the support beam 19. The conveyor 20 can then stop the bale 12 in this position (FIG. 1B). Then, the actuating system 54 can move the support beam 19 to its lowered position and the arms 30 to their extended position to contact the bale 12 and hold the bale 12 against the support surface 23 (i.e., the arms 30 and support surface 23 can cooperate to slightly compress the bale 12 to hold the bale 12 in a fixed position) (FIG. 1B). While the bale 12 is held in this position, the cutting device 22 can extend upwards toward the bale 12 to cut the binding 14 therefrom. Once the bindings 14 are cut, the bindings 14 can remain loosely draped over the top and sides of the outer surface 13 of the bale 12. Then, the binding remover 24 can operate to remove the bindings 14 from the bale 12 as will be discussed.

Once the binding 14 is removed, the actuating system 54 can move the arms 30 to the retracted position (shown in phantom in FIG. 1B), and the actuating system 54 can move the support beam 19 to its raised position. Then, the conveyor 20 can advance the bale 12 toward other components (e.g., a chopper) for further processing.

In some embodiments, the support beam 19 and/or the arms 30 can be operably connected to the sensor device 56 for varying the movement of those components according to the size of the bale 12. For instance, the sensor device 56 can include a height sensor that automatically determines the height H of the bale 12 (measured normal to the support surface 23). Thus, the controller 33 can calculate the vertical distance of travel of the support beam 19 (from the raised position to the lowered position) and/or the distance of travel of the arms 30 (from the retracted position to the extended position) based on the detected height of the bale 12. As a further example, the sensor device 56 can include a switch that is triggered to stop movement of the support beam 19 and/or the arms 30 toward the bale 12 when the support beam 19 and/or arms 30 contact the bale 12 and/or when the applied pressure exceeds a predetermined threshold.

Referring now to FIGS. 5-10, embodiments of the binding remover 24 will be discussed. As mentioned, the binding remover 24 can include a head member 26. The head member 26 can be substantially flat and triangular or otherwise tapered to terminate at a pointed end 31 (FIG. 6). The head member 26 can also include an upper post 29 that is spaced away from the pointed end 31 of the head member 26. A head opening 60 (i.e., throat) can be defined between the end 31 and the post 29. The head member 26 can further include a support bracket 61, a portion of which extends horizontally, and a portion of which extends vertically to attach to a chain drive 63 (FIG. 1B). Supported as such, the tapered or pointed end 31 of the head member 26 can be pointed toward the arranging member 27 and the winder 28.

The chain drive 63 can extend along the beam 19, and the chain drive 63 can be operably coupled to the actuating system 54 to actuate the head member 26 in a linear direction along the beam 19. Moreover, the movement of the head member 26 can be controlled by the controller 33. Thus, the head member 26 can move between a first position (FIGS. 5 and 6) and a second position (FIG. 10). In the first position, the head member 26 can be disposed on an end of the beam 19 opposite the arranging member 27 and the winder 28. In the second position, the head member 26 can be disposed adjacent the arranging member 27 and the winder 28.

Figure 7:
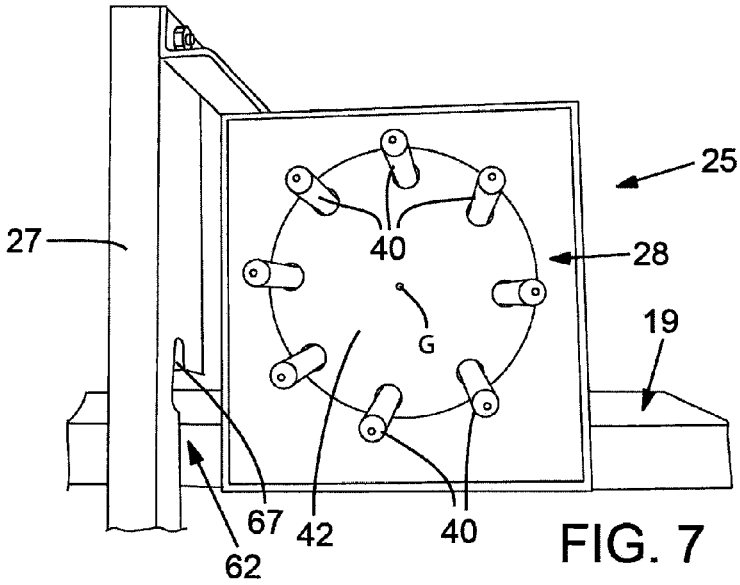
FIG. 7 is a bottom view of tines of the gathering member of FIG. 6.
Figure 8:
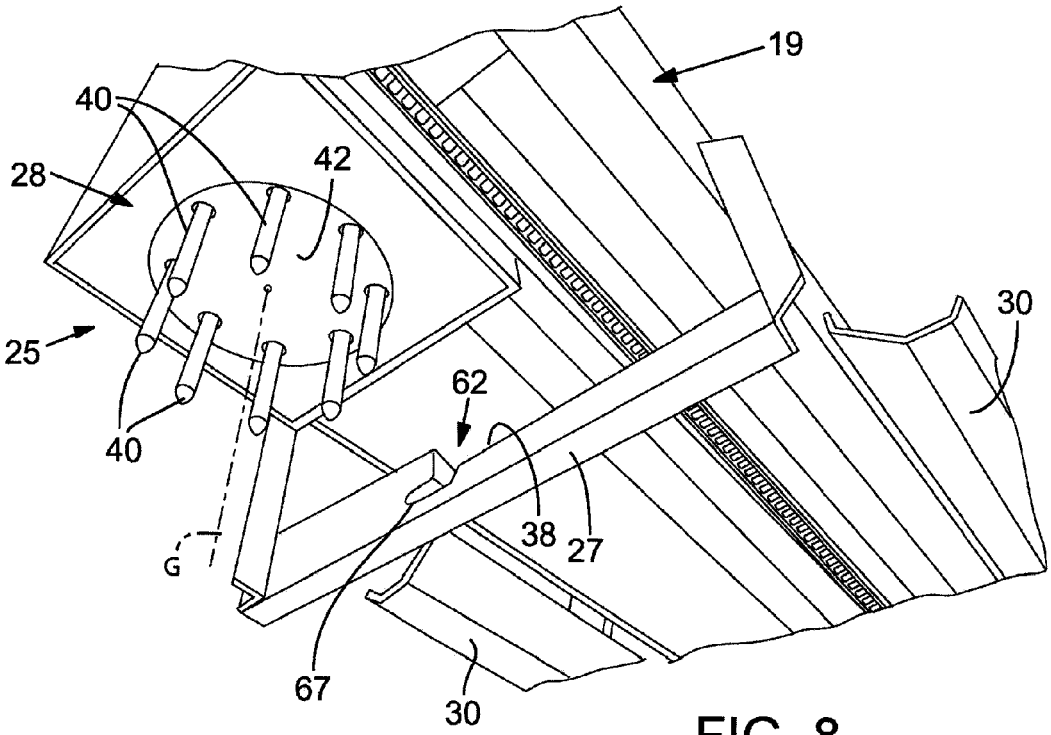
FIG. 8 is a bottom view of the tines of the gathering member of FIG. 6.

As shown in FIGS. 7 and 8, the arranging member 27 can be an elongate bar with an upper support surface 38. The arranging member 27 can be fixed to the support beam 19 at both ends so as to extend transverse to the support beam 19 and to be suspended therefrom. As such, a support opening 62 can be defined above the arranging member 27 and below the support beam 19. The support opening 62 can include a notch 67 formed within the arranging member 27. As will be discussed, the support opening 62 can be large enough to allow passage of the head member 26 therethrough.

As shown in FIGS. 7 and 8, the winder 28 can include a round base plate 42 and one or more (e.g., eight) tines 40. In the illustrated embodiments, there is a plurality of tines 40, and the tines 40 are spaced evenly about a gathering axis G. Each tine 40 can be a straight rod, and the tines 40 can be operably coupled to the actuating system 54 to move linearly (e.g., parallel to the axis G) between an extended (downward) position (FIGS. 7, 8, and 10) and a retracted (upward) position (FIG. 9) relative to the plate 42. Also, the plate 42 and tines 40 can also be coupled to the actuating system 54 for collective rotation about the axis G.

Thus, assuming that the bindings 14 have been cut from the bale 12 and the support beam 19 remains in the lowered position with the arms 30 holding the bale against the support surface 23, the head member 26 can actuate from its first position (FIGS. 5 and 6) horizontally along the axis of the support beam 19 toward the bale 12. During movement of the head member 26, the pointed end 31 can penetrate (i.e. partially dig into) the bale 12 while the end 31 moves across the outer surface 13 (see FIG. 1B). Thus, the end 31 can move underneath the bindings 14 (between the biomass of the bale 12 and the bindings 14). Further movement of the head member 26 toward the second position (FIG. 10) causes the end 31 to direct the bindings 14 into the head opening 60 between the end 31 and the post 29. The head member 26 can continue to move out of the bale 12, and toward the winder 28, dragging the cut bindings 14 behind.

The head member 26 can continue to move through the support opening 62 while dragging the cut bindings 14 behind. The bindings 14 can slide over the upper surface 38 of the arranging member 27 and can gather within the notch 67 of the arranging member 27. Thus, the arranging member 27 can move the cut bindings 14 into alignment and generally constrain the bindings 14 from movement as the head member 26 moves through the opening 62 and drags the bindings 14 through the opening 62.

The head member 26 can move further, and assuming that the tines 40 of the winder 28 are positioned upwards in the retracted position (FIG. 9), the head member 26 can move past the winder 28. After bypassing the winder 28, the head member 26 can come to rest in its second position shown in FIG. 10.

As shown in FIG. 10, the cut bindings 14 can hang and can be supported between the head member 26 and the upper surface 38 of the arranging member 27. Stated differently, the head member 26 and the arranging member 27 can cooperate to support the cut bindings 14 at a predetermined position (i.e., predetermined arrangement) beneath the winder 28. It will be appreciated that when the bindings 14 are in this predetermined position, the bindings 14 are generally neat, constrained against inadvertent movement, and otherwise controlled.

Then, the tines 40 of the winder 28 can actuate downward to their extended positions (FIG. 10) such that a portion of the binding 14 is positioned between at least two tines 40. Subsequently, the plate 42 and the tines 40 can rotate as a group about the axis G. Consequently, the bindings 14 can be pulled from the head member 26 and the arranging member 27, and the tines 40 can wind the bindings 14 thereabout. Once sufficiently wound about the tines 40, the tines 40 can retract upward into the plate 42 such that the bindings 14 fall away from the plate 42 and are expelled into a container positioned underneath the winder 28.

Thereafter, the bale 12 can be released and moved downstream to another station for further processing (e.g., chopping). Specifically, the blade 34 can move downward to its retracted position, the arms 30 of the holder 21 can swing upward toward the support beam 19 to release the bale 12, and the beam 19 can be actuated upward away from the bale 12. Then, the unbound bale 12 can be further conveyed by the conveyor 20 for further processing (e.g., chopping, etc.). Moreover, the head member 26 can return to its first position (FIGS. 5 and 6). Accordingly, the apparatus 10 can automatically return to its initial configuration for cutting and removing bindings 14 from another bale 12 for continuous processing of more bales 12.

Accordingly, the apparatus 10 can provide very efficient means for automatically cutting and removing bindings 14 from bales 12 of biomass or other materials. Thus, the materials can be processed in a more efficient manner.

Figure 13:
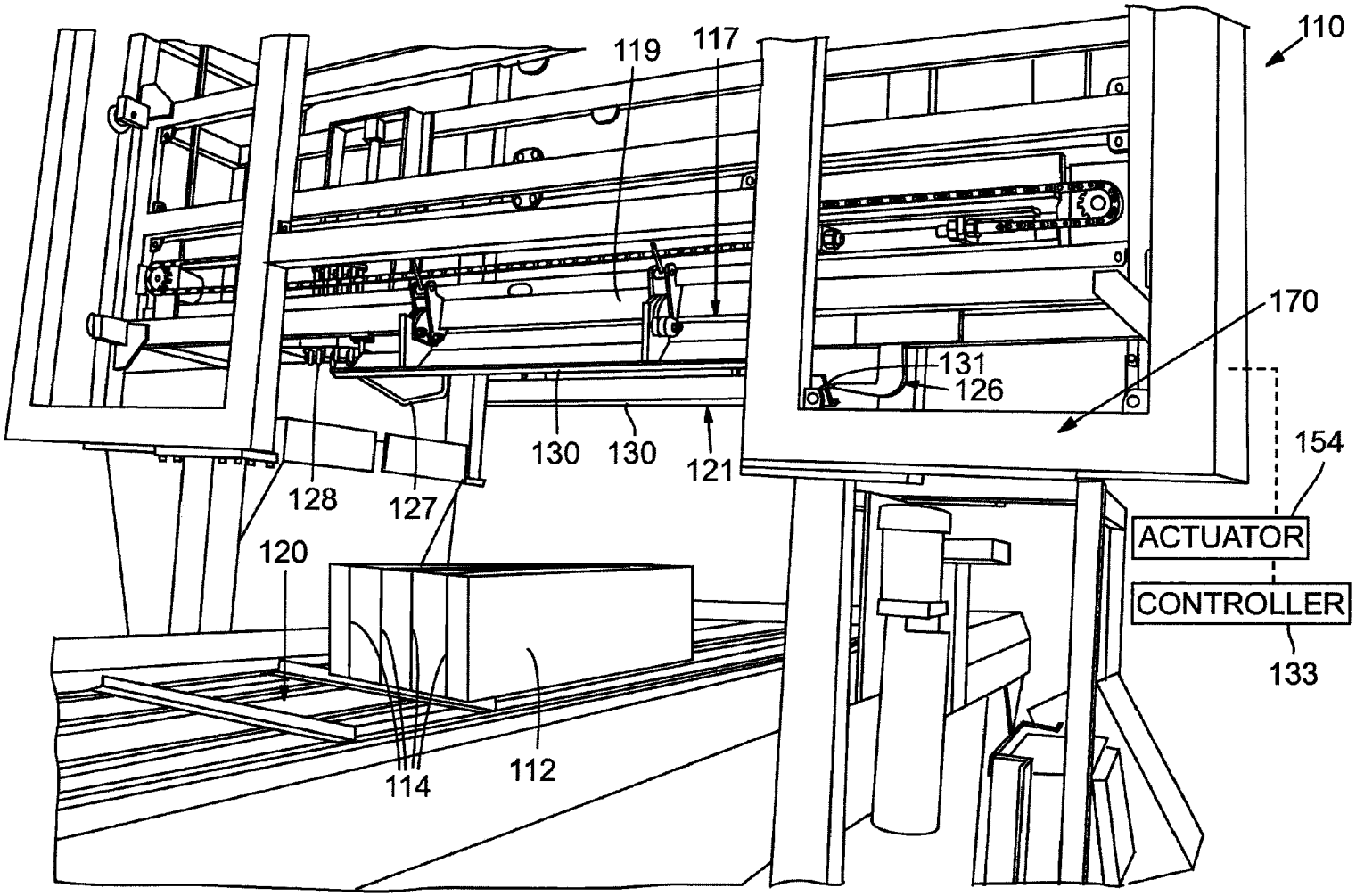
FIG. 13 is a perspective view of a bale processing apparatus according to additional embodiments of the present disclosure.

Referring now to FIG. 13, additional exemplary embodiments of the bale processing apparatus 110 are illustrated. Components that correspond to those of the embodiments of FIGS. 1-10 are indicated with corresponding reference numerals increased by 100.

As shown in FIG. 13, the apparatus 110 can include an outer cage 170 that moveably supports a support assembly 117. The outer cage 170 can include a plurality of beams that are connected together for moveably supporting the support assembly 117. The support assembly 117 can also include a plurality of connected beams, and the support assembly 117 can include the support beam 119, which supports the bale holder 121 (e.g., the arms 130), the head member 126, the arranging member 127, and the winder 128 thereon. The support assembly 117 can also be operably connected to the actuating system 154 for selectively moving vertically up and down relative to the outer cage 170. Also, in some embodiments, the support assembly 117 can be moveably connected to the outer cage 170 and/or the actuating system 154 by a chain drive (not shown) for guiding and moving the support assembly 117 vertically up and down relative to the outer cage 170.

The apparatus 110 can have a blade or other cutting device (not specifically shown) that is substantially similar to the embodiments described above with respect to FIGS. 1-10. Also, the arms 130 of the bale holder 121 can be substantially similar to the embodiments described above with respect to FIGS. 1-10. Thus, cutting of the bindings 114 can occur in a substantially similar fashion to the embodiments discussed above with respect to FIGS. 1-10.

Figure 14:
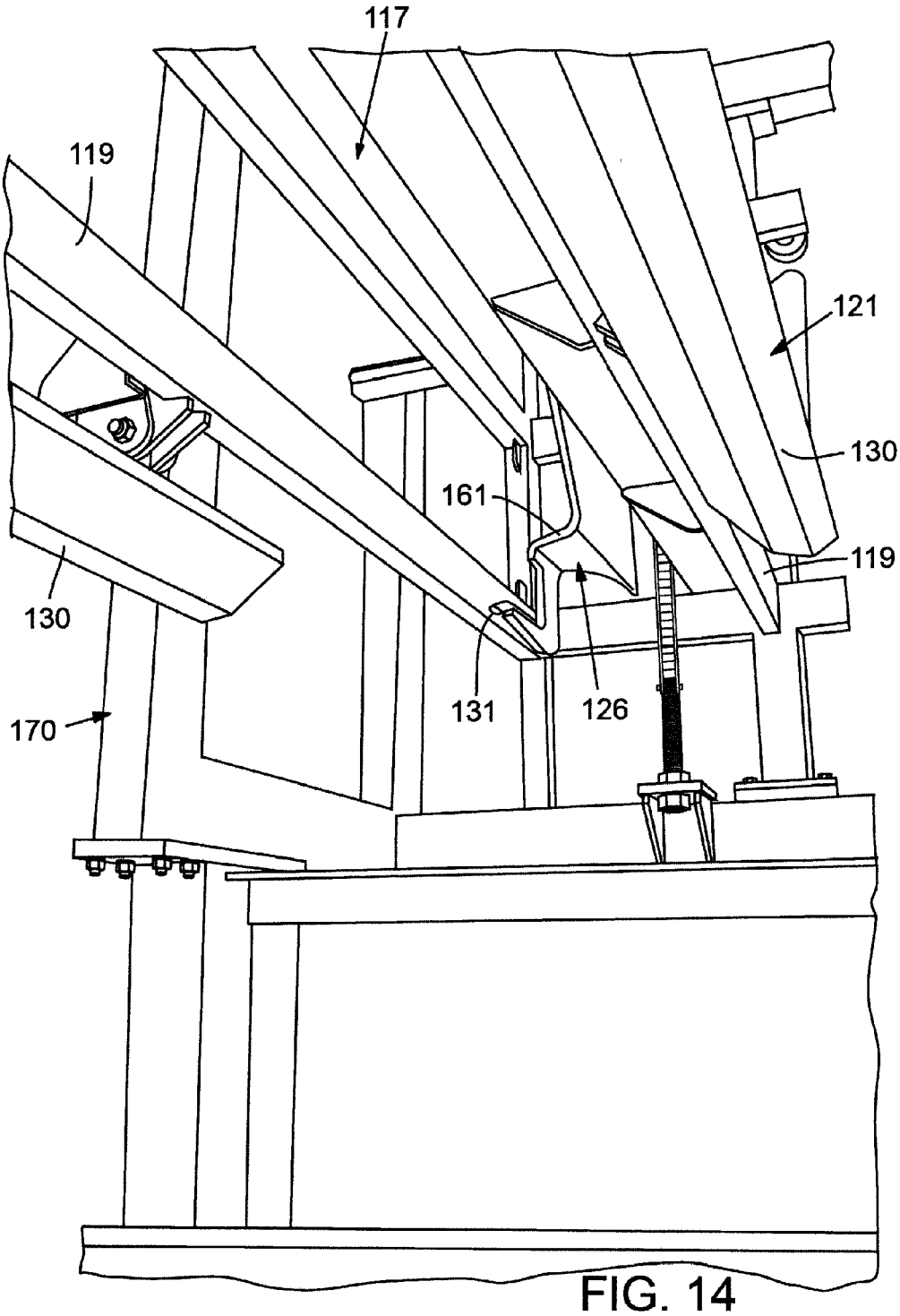
FIG. 14 is a perspective view of a binding remover of the bale processing apparatus of FIG. 13.

As shown in FIG. 14, the head member 126 can include an end 131 that terminates at a point and that is angled downward for penetrating into the bale and dragging the binding therefrom, similar to the embodiments discussed above. The support bracket 161 can extend horizontally from the head and vertically upwards to connect to a chain drive, which extends along the beam 119, similar to the embodiments discussed above.

Figure 15:
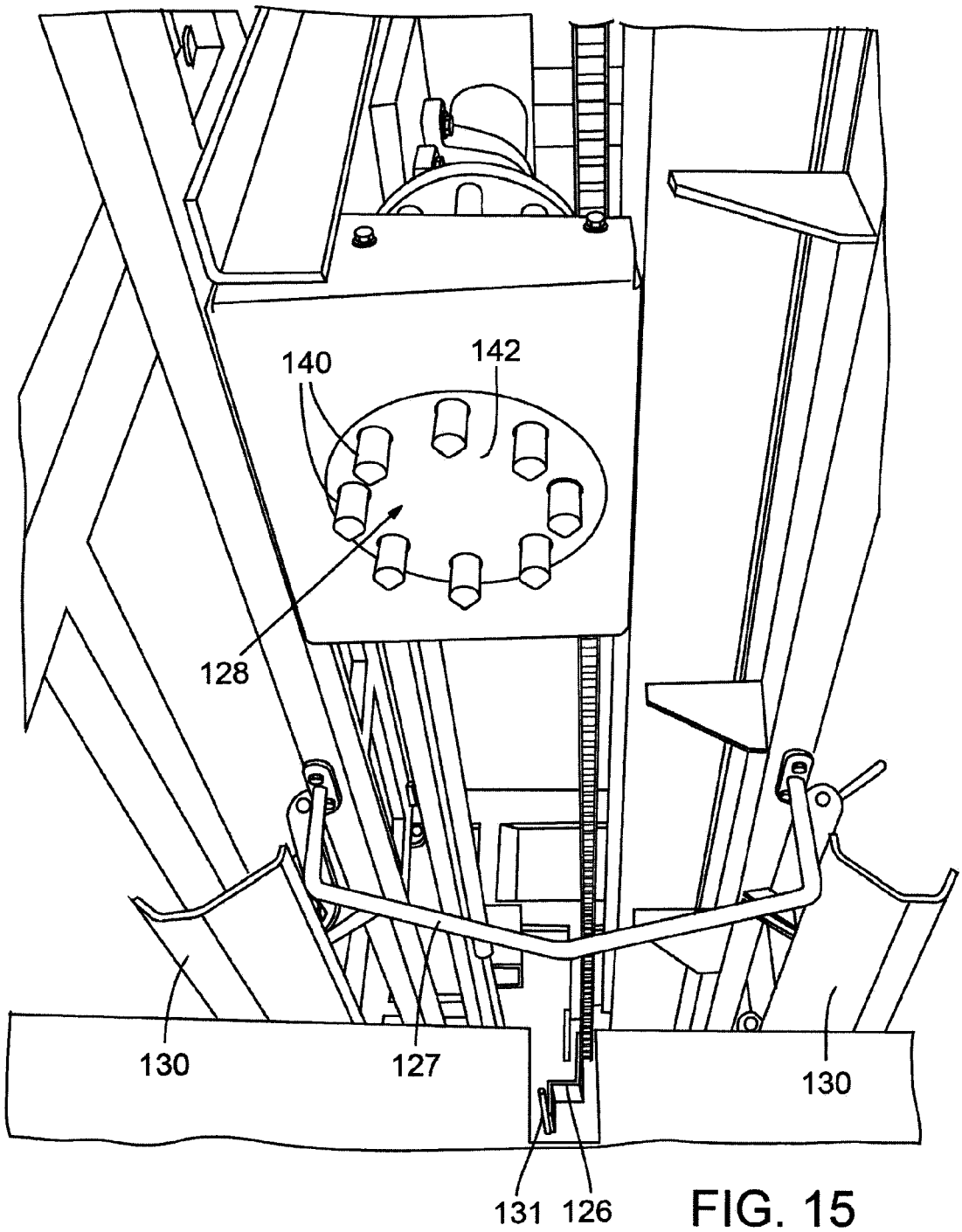
FIG. 15 is a perspective view of a guide member and a gathering member of the bale processing apparatus of FIG. 13.

Additionally, the arranging member 127 (shown in FIG. 15) can be a generally V-shaped bar that is suspended at both ends from the support beam 119. The arranging member 127 can be centered with respect to the line of travel of the head member 126 to allow the head member 126 to move through the arranging member 127. Like the embodiments discussed above with respect to FIGS. 1-10, the head member 126 can move through the arranging member 127 such that the cut bindings 114 are suspended between the head member 126 and the arranging member 127, below the tines 140 of the winder 128.

The winder 128 can be configured similar to the embodiments of FIGS. 1-10. Thus, as described above with respect to the embodiments of FIGS. 1-10, the winder 128 can rotate to wind and collect the bindings 114 from the head member 126 and arranging member 127.

The support beam 119 can be raised from the now unbound bale 112 to release the bale 112. Then, the conveyor 120 can move the bale 112 toward another station to be processed (e.g., for chopping, screening, quality control, etc.).

Accordingly, the bale processing apparatus 10, 110 can efficiently and effectively receive bales 12, 112 of material and can automatically unbind the bales 12, 112 and prepare the bales 12, 112 for further processing. Thus, the apparatus 10, 110 can dramatically reduce the number of man hours required for processing bales 12, 112. Furthermore, the bale processing apparatus 10, 110 can be implemented in a continuous processing system (e.g., such that the apparatus 10, 110 automatically passes on unbound bales 12, 112 to a chopper, etc.) for further increasing efficiency.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A bale processing apparatus for processing a bale of biomass that is bound by a binding, the bale processing apparatus comprising:

a cutting device that is operable to automatically cut the binding;

a binding remover that is operable to automatically move the binding from the bale after the binding has been cut by the cutting device, the binding remover including a head member that is movably mounted relative to the bale to move the binding from the bale; and an arranging member that cooperates with the binding remover to automatically arrange the binding generally into a predetermined position, the arranging member defining a support opening, the head member operable to move through the support opening and drag the binding through the support opening to thereby generally align and arrange the binding into the predetermined position.

2. The bale processing apparatus of claim 1, further comprising a support surface operable to support the bale, and a bale holder that selectively holds the bale against the support surface while the cutting device cuts the binding.

3. The bale processing apparatus of claim 2, further comprising a height sensor that is operable to detect a height of the bale, the height measured from the support surface, the bale holder operable to actuate a distance toward the support surface to engage the bale, the distance determined according to the height of the bale detected by the height sensor.

4. The bale processing apparatus of claim 2, wherein the cutting device is operable to actuate linearly in a first direction and a second direction, the second direction being opposite the first direction, the first direction and the second direction being normal to the support surface.

5. The bale processing apparatus of claim 1, wherein the binding extends across an outer surface of the bale, and further comprising a support surface operable to support the bale, and wherein the head member is movably mounted relative to the support surface to move transverse to the binding and across the outer surface to contact and move the binding from the bale.

6. The bale processing apparatus of claim 5, wherein the head member includes an end and a head opening, and wherein the head member is operable to move across the outer surface such that the end digs into the bale below the binding, such that the end directs the binding into the head opening, and such that the head member drags the binding from the bale.

7. The bale processing apparatus of claim 6, further comprising a gathering member operable to automatically gather the binding from at least one of the head member and the arranging member when the binding is in the predetermined position.

8. The bale processing apparatus of claim 7, wherein the gathering member includes at least one tine that rotates about a gathering axis to automatically wind the binding about the at least one tine.

9. The bale processing apparatus of claim 8, wherein the gathering member also includes a base, wherein the at least one tine is moveably supported relative to the base to move between a retracted position and an extended position, wherein the head member is operable to move the binding into a predetermined position relative to the at least one tine when the at least one tine is in the retracted position, and wherein the at least one tine is operable to move from the retracted position to the extended position and to rotate about the gathering axis to thereby wind the binding about the at least one tine.

10. The bale processing apparatus of claim 9, wherein the at least one tine is operable to move from the extended position to the retracted position to thereby expel the binding from the gathering member.

11. The bale processing apparatus of claim 7, wherein the head member is operable to move through the support opening and to drag the binding through the support opening as the head member moves away from the bale to thereby generally align and arrange the binding into the predetermined position, the arranging member and the head member operable to cooperatively support the binding while the gathering member automatically gathers the binding.

12. The bale processing apparatus of claim 1, further comprising a bale sensor that is operable to detect at least one of a metal content of the bale, a moisture content of the bale, a size of the bale, and a weight of the bale.

13. The bale processing apparatus of claim 1, further comprising a conveyor that automatically conveys the bale toward the cutting device.

14. A biomass processing apparatus for processing a bale of biomass, the bale of biomass including a binding, the biomass processing apparatus comprising:

a cutting device that is operable to automatically cut the binding;

a conveyor that conveys the bale of biomass with the binding toward the cutting device;

a holding device that selectively and automatically holds the bale against a support surface, wherein the cutting device automatically cuts the binding while the holding device holds the bale against the support surface;

a binding remover that is operable to automatically remove the binding from the bale of biomass after the binding has been cut by the cutting device, the binding remover including a head member that moves linearly across an outer surface of the bale, an end of the head member operable to penetrate into the bale to move between the bale and the binding as the head member moves linearly across the outer surface of the bale, the end operable to direct the binding into a head opening of the head member, the head member operable to drag the binding from the bale as the head member moves away from the bale;

an arranging member that defines a support opening, the head member operable to move through the support opening and to drag the binding through the support opening to thereby generally align and arrange the binding into a first predetermined position, the arranging member and the head member operable to cooperatively support the binding when in the first predetermined position;

a gathering member operable to automatically gather the binding from the head member while the head member and the arranging member cooperatively support the binding, the gathering member including a base and a plurality of tines that are operable to rotate about a gathering axis, the plurality of tines operable to move between a retracted position and an extended position, wherein the plurality of tines are operable to move from the retracted position to the extended position and to rotate about the gathering axis to thereby wind the binding about the plurality of tines, and wherein the plurality of tines are operable to move from the extended position to the retracted position to thereby expel the binding from the gathering member; and a sensor that is operable to detect at least one of a metal content of the bale, a moisture content of the bale, a size of the bale, and a weight of the bale.

* * * * *